US006607567B1

(12) United States Patent
Towfighi

(10) Patent No.: US 6,607,567 B1
(45) Date of Patent: Aug. 19, 2003

(54) PROPELLANT GAS FOR TOOLS OPERATED BY COMBUSTION POWER

(75) Inventor: Kaveh Towfighi, Sigmarszell (DE)

(73) Assignee: Hilti Aktiengesellschaft, Schaan (LI)

( * ) Notice: Subject to any disclaimer, the term of this patent is extended or adjusted under 35 U.S.C. 154(b) by 120 days.

(21) Appl. No.: 09/680,141

(22) Filed: Oct. 4, 2000

(30) Foreign Application Priority Data

Oct. 19, 1999 (DE) ..... 199 50 348

(51) Int. Cl.[7] ..... C10L 1/18
(52) U.S. Cl. ..... 44/448; 149/1
(58) Field of Search ..... 149/1; 44/448

(56) References Cited

U.S. PATENT DOCUMENTS 3,660,059 A 5/1972 Hollemann et al.
3,730,093 A * 5/1973 Cummings ..... 102/363
4,047,876 A * 9/1977 Rice ..... 431/170
4,076,562 A * 2/1978 Forsythe ..... 149/47
4,902,539 A * 2/1990 Jackson ..... 149/109.2
5,181,495 A * 1/1993 Gschwend et al. ..... 60/632
5,632,786 A * 5/1997 Basu et al. ..... 44/448
5,842,623 A 12/1998 Dippold
2002/0005010 A1 * 1/2002 Rosenbaum ..... 44/448

FOREIGN PATENT DOCUMENTS

DE 4032202 4/1992
GB 1370521 10/1974

* cited by examiner

*Primary Examiner*—Edward A. Miller
(74) *Attorney, Agent, or Firm*—Sidley Austin Brown & Wood, LLP

(57) ABSTRACT

A propellant gas is described for tools, operated by combustion power, especially for setting equipment for fastening elements, on the basis of combustible gases containing a mixture of (A) 40% to 70% by weight of dimethyl ether, nitrous oxide and/or nitromethane, (B) 8% to 20% by weight of propylene, methyl acetylene, propane and/or propadiene and (C) 20% to 45% by weight of isobutane and/or n-butane.

6 Claims, No Drawings

PROPELLANT GAS FOR TOOLS OPERATED BY COMBUSTION POWER

BACKGROUND OF THE INVENTION

1. Field of Invention

The present invention relates to a propellant gas for tools, especially for setting tools for fastening elements operated by combustion power, based on combustible gases.

2. Description of the Prior Art

Tools of the type in question, operated by combustion power, namely setting tools for fastening elements, are disclosed in DE-A-4 032 202. With the help of these tools, fastening elements, such as nails, bolts, etc., are driven directly under the action of the combustion power, normally a powder charge, into materials such as wood, steel, concrete and the like, to which the component in question is to be fastened.

Such tools, operated by combustion power, comprise a combustion chamber and a piston, which can be moved in a piston guide and is acted upon by the expanding combustion gases produced in the combustion chamber. By igniting a mixture of air and fuel present within the combustion chamber or by igniting a powder propellant charge, the piston is moved away from the combustion chamber, strikes the fastening element and drives it into the constructional component. At the same time, the energy, gained by burning the propellant gas, depends very much on the combustion rate, which in turn depends on the ratio of air to gas.

Tools of this type, operated by combustion power, are also disclosed, for example, in DE-A-40 32 20 and U.S. Pat. No. 5,842,623.

The tool, which is operated by combustion power and described in U.S. Pat. No. 5,842,623, is operated by a mixture of methyl acetylene and propadiene or a mixture of propane, butane, propylene or ethane as propellant gas. For conventional, commercial tools of the type in question, which are operated by combustion power, especially mixtures of methyl acetylene, propadiene, propylene and butane are used, which are also known under the name of MAPP. This gas is a waste product of the coking of hard coal and has a relatively high combustion rate, which is important for a high efficiency of the tools.

However, these conventional propellant gases have considerable disadvantages. For example, the usually employed MAPP mixtures generally contain small amounts of butadiene, which is poisonous and permissible only in amounts of less than 0.1% by weight. MAPP gases, free of butadiene, are difficult to obtain and expensive. The usual hydrocarbon mixtures or pure fuel gases, such as butane or propane, burn more slowly and are unsuitable for the present application.

In particular, most of the known gas mixtures, used as propellant gases, evaporate slowly and weakly at low temperatures (−5° C.). This is a problem for the tools under discussion, since the latter must function at building sites even at temperatures below 0°C.

On the other hand, hydrocarbons, which burn rapidly, can be obtained only at high costs and frequently have vapor pressures, which are too high. This makes it difficult to adhere to the regulations of the authorities concerning the handling of aerosols.

Accordingly, the object of the present invention is a propellant gas for tools, operated by combustion power, especially for setting tools for fastening elements, which is not poisonous, can be procured simply and inexpensively, has the required combustion energy, makes a selective adjustment of this combustion energy possible, can be used even at low temperatures and makes it possible to comply with the aerosol regulations.

SUMMARY OF THE INVENTION

This and other objects of the present invention, which will become apparent herein after, are achieved by using a propellant gas in the form of a mixture of three components in a particular ratio by weight, these components, themselves possibly representing mixtures.

DETAILED DESCRIPTION OF THE PREFERRED EMBODIMENT

The inventive propellant gas is a mixture containing (A) 40% to 70% by weight of dimethyl ether, nitrous oxide and/or nitromethane, (B) 8% to 20% by weight of propylene, methyl acetylene, propane and/or propadiene and (C) 20% to 45% by weight of isobutane and/or n-butane, the sum of the components amounting to 100% by weight.

The components (A), (B) and (C) may contain one or more representatives of the combustible gases given.

Component (A) preferably is present in an amount of 50% to 60% by weight, component (B) in an amount of 10% to 15% by weight and component (C) in an amount of 25% to 35% of the gas mixture.

Preferably, the inventive propellant gas contains dimethyl ether as component (A), propylene as component (B) and isobutane as component (C). Pursuant to a particularly preferred embodiment, the inventive propellant gas comprises a mixture of 58% by weight of dimethyl ether, 14% by weight of propylene and 28% by weight of isobutane.

In addition, the inventive propellant gas may contain small amounts of other combustible gases, which are not poisonous and do not affect the vapor pressure and the combustion rate of the gas mixture disadvantageously.

The dimethyl ether, preferably used as component (A) pursuant to the invention, is known as a coolant and as a propellant for aerosol spray cans. Recently, the use of dimethyl ether as a fuel in the automobile industry has also been considered. In this connection, reference is made to U.S. Pat. No. 5,626,294.

With the help of component (A) and especially of the dimethyl ether, the use of which is preferred pursuant to the invention, it is possible to form a propellant gas, which makes possible the desired vaporization pressure even at low temperatures. Dimethyl ether has a relatively broad ignition window, that is, a large ratio of gas to air, in which the mixture is capable of igniting. Dimethyl ether is not classified as poisonous and, surprisingly, brings about a combustion rate greater than that of the MAPP mixture conventionally used. The molecule of dimethyl ether contains an oxygen atom, which leads to improved combustion, which means, percentage-wise, that less air has to be admixed when the inventive propellant gas is used than when pure hydrocarbons are used. This in turn makes smaller combustion chambers possible for the tools operated by combustion power and, with respect to the waste gases ejected, is advantageous. The vaporization pressure of dimethyl ether is not too high (5.1 bar (absolute) at 20° C. and 11.7 bar at 50° C.), so that it is suitable for use in aerosol cans. This makes it possible to use the inventive propellant gas in a compressed or liquefied form in a pressure container with a delivery valve.

The combustible gases, nitrous oxide and nitromethane, which can also be used as component (A), have physical and chemical properties, advantageous for the aimed-for use as propellant gas for tools operated by combustion power. Nitromethane can therefore be used alone or in mixtures with nitrous oxide and/or in combination with dimethyl ether in the claimed propellant gas. In this connection, the individual components are used in such amounts, that a vapor pressure results, which is suitable for the intended use.

Component (B) contains a reactive double bond in its molecule, which leads to improved combustion of the molecule and, with that, of the propellant gas mixture. The relatively high vaporization pressure of this component, namely of the preferably used propylene (10.2 bar at 20° C. and 5 bar at 5° C.), favors the atomization of the other components of the propellant gas through the nozzles when the propellant gas is introduced into the combustion chamber of the tool.

The component (C), namely isobutane, is used to stabilize the mixture. It is gaseous at temperatures above −11.5° C. and therefore also permits advantageous combustion.

By combining dimethyl ether, nitrous oxide and/or nitromethane alone in combination with one another, with the other inventive components (B) and (C), a propellant gas mixture results, which is distinguished by a surprisingly advantageous, balanced combination of physical, chemical and environmental properties. The claimed propellant gas is distinguished on the basis of the combination of components (A), (B) and (C) by a behavior, which meets practical requirements particularly well during the manufacture and during the filling into containers, and especially also during the handling, in that the mixture readily fulfills the aerosol requirements and can be taken from the pressure containers with conventional metering valves without causing problems with the materials of the valves. Furthermore, the inventive propellant gas has an outstanding ignitability and combustion rate even at low temperatures (−5° C.), as a result of which the setting of fastening elements can be accomplished in a satisfactory and safe manner even under climatically unfavorable conditions.

The inventive propellant gas may additionally contain a lubricant based, for example, on mineral oil or silicone oil, for lubricating the valve devices, which are necessary for introducing the propellant gas into the combustion chamber.

The following example explains the invention further.

EXAMPLE

A propellant gas mixture is formed from 58% by weight of dimethyl ether as component (A), 14% by weight of propylene as component (B) and 28% by weight of isobutane as component (C). At 50° C., the gas mixture has a vaporization pressure of 11.6 bar and, with that, complies with legal aerosol regulations.

For the operation of a setting tool for fastening elements operated by combustion power, it has been observed that the inventive propellant gas makes possible a smooth residue-free combustion with exhaust gases, which are not poisonous and are free of pollutants, with a high release of energy, so that fastening elements can be driven into substrate material without any problems. At the same time, it has been observed that the inventive propellant gas can also be used at low temperatures of −5° C. without any problems.

What is claimed is:

1. A propellant gas for use in tools, which are operated by power generated by combustion of combustible gases, and for storing in pressure containers, the propellant gas consisting essentially of a mixture containing (A) 40% to 70% by weight of dimethyl ether, (B) 8% to 20% by weight of propylene, methyl acetylene, propane and/or propadiene, and (C) 20% to 45% by weight of isobutane and/or n-butane.

2. The propellant gas of claim 1, wherein the gas comprises a mixture of 50% to 60% by weight of component (A), 10% to 15% by weight of component (B) and 25% to 35% by weight of component (C).

3. The propellant gas of claim 1, wherein the gas additionally contains at least one lubricant.

4. The propellant gas of claim 3, wherein the gas contains a lubricant based on mineral oil and/or silicone oil.

5. The propellant gas of claim 1, wherein the gas contains propylene as component (B) and isobutane as component (C).

6. The propellant gas of claims 5, wherein the gas comprises a mixture of 58% by weight of component (A), 14% by weight of component (B), and 28% by weight of component (C).

* * * * *